United States Patent [19]

Senderoff

[11] 4,048,027

[45] Sept. 13, 1977

[54] PROCESS FOR PRODUCING ELECTROLYTIC $MnO_2$ FROM MOLTEN MANGANESE NITRATE HEXAHYDRATE

[75] Inventor: Seymour Senderoff, Fairview Park, Ohio

[73] Assignee: Union Carbide Corporation, New York, N.Y.

[21] Appl. No.: 671,970

[22] Filed: Mar. 30, 1976

[51] Int. Cl.[2] ..... C25B 1/00

[52] U.S. Cl. ..... 204/61

[58] Field of Search ..... 204/61, 83, 96

[56] References Cited

U.S. PATENT DOCUMENTS 3,852,171 12/1974 Turchaninov ..... 204/96

FOREIGN PATENT DOCUMENTS 379,534 4/1973 U.S.S.R.

OTHER PUBLICATIONS

Chemical Eng. Series. McGraw-Hill Book Co., N.Y., 1950, pp. 471–472.

*Primary Examiner*—John H. Mack
*Assistant Examiner*—H. A. Feeley
*Attorney, Agent, or Firm*—Cornelius F. O'Brien

[57] ABSTRACT

A process for producing electrolytic manganese dioxide by electrolyzing molten manganese nitrate hexahydrate at a temperature between about 115° C. and 126° C. and with an anodic current density of from about 140 to about 300 mA/cm².

6 Claims, 5 Drawing Figures

PROCESS FOR PRODUCING ELECTROLYTIC $MNO_2$ FROM MOLTEN MANGANESE NITRATE HEXAHYDRATE

FIELD OF THE INVENTION

The invention relates to an improved process for producing electrolytic manganese dioxide by the electrolysis of molten manganese nitrate hexahydrate at a temperature between about 115° C. and about 126° C. and with an anodic current density of from 140 to 300 mA/cm².

BACKGROUND OF THE INVENTION

The use of manganese dioxide as an active cathode material (depolarizer) in dry cells is well known. Manganese dioxide for cell use can be formed of natural manganese dioxide ores or it can be electrolytically produced by electrolyzing a manganous sulfate solution as disclosed in the publication titled "Batteries" - Vol. 1, edited by Karl V. Kordesch and published by Marcel Dekker, Inc., New York, 1974. Specifically, the process entails the feeding of a preheated $MnSO_4$—$H_2SO_4$ bath into an electrolytic cell which is operated with direct current under the following general conditions:

a. electrolyte concentration — $MnsO_4$, 0.5 to 1.2 mole/liter; $H_2SO_4$, 0.5 to 1.0 mole/liter;
b. electrolyte temperature, 80° C to 100° C.; and
c. an anodic current density of 7 to 12 mA/cm².

The anode material generally employed in this type process is titanium, lead alloy or carbon. During electrolysis, the $MnSO_4$ concentration decreases and the $H_2SO_4$ concentration increases in the electrolyte with the net result being that $MnO_2$ is deposited at the anode and $H_2SO_4$ is formed in the electrolyte. The $MnO_2$ is then removed from the anode and after conventional post-treatment, it is ready for use as an active cathode material in dry cells.

In Russian Inventor's Certificate No. 379,534 to F. K. Andryushchencko et al published July 5, 1973, another electrolytic process is disclosed for the production of electrolytic manganese dioxide which entails the electrolysis of molten manganese nitrate hexahydrate at a temperature of 90° C. to 105° C. and with an anodic current density of 10 to 15 mA/cm².

It is an object of the present invention to provide an improvement in the process disclosed in Russian Inventor's Certificate No. 379,534 for producing battery grade $MnO_2$ from electrolyzed molten $Mn(NO_3)_2.6H_2O$.

It is another object to provide a process for producing electrolytic manganese dioxide from molten manganese nitrate hexahydrate that will yield manganese dioxide equal to or superior to the commercially available manganese dioxide obtainable from the electrolysis of an aqueous manganous sulfate solution.

Still another object is to provide a process for producing manganese dioxide from molten nitrate manganese hexahydrate whereby manganese dioxide can be deposited on the anodic electrode at a faster rate, i.e. 10 times or more, than the deposition of manganese dioxide using the electrolytic process of an aqueous manganous sulfate solution or the process disclosed in Inventor's Certificate No. 379,534.

SUMMARY OF THE INVENTION

The invention relates to a process for producing battery grade electrolytic manganese dioxide by electrolyzing molten manganese nitrate hexahydrate $[Mn(NO_3)_2.6H_2O]$ at a temperature between about 115° C. and about 126° C. and with an anodic current density of from about 140 to about 300 mA/cm². The optimum conditions for the electrolysis of molten manganese nitrate hexahydrate considering current efficiency, quality of the manganese dioxide deposit, grindability of the manganese dioxide deposit, and discharge properties of the manganese dioxide deposit, are to conduct the electrolysis at a temperature of 117° C. ± 2° C. and withan anodic current density offrom about 150 to 200 mA/cm². In the electrolytic cell for use in this invention, the material of the anodic electrode could be selected from the group consisting of carbon including graphite, precoated lead, i.e., precoated with $MnO_2$, for example, and titanium, with carbon being the preferred material. The cathodic electrode of the cell could be carbon, including graphite, or any metallic conductive material preferably having a low hydrogen overvoltage, such as stainless steel, platinum, titanium, zirconium or the like.

It has been found that the higher the temperature at which the electrolysis of the molten manganese nitrate hexahydrate can be conducted, the better the electrochemical properties of the manganese dioxide produced. However, at temperatures above about 126° C., the manganese nitrate hexahydrate begins to thermally decompose as evidenced by the discharge of brown fumes i.e., $NO_2$, from the electrolytic cell. Thus the high temperature limitation of about 126° C. is necessary if thermal decomposition of the molten nitrate is to be avoided. However, unexpectedly it has been found that conducting the electrolytic process at 117° C. ± 2° C., the electrochemical properties of the manganese dioxide produced are optimized such that its performance as an active cathode material in a battery is equal to or superior to that of the best commercially available manganese dioxide produced by the electrolysis of an aqueous manganous sulfate solution and far superior to that of the manganese dioxide produced in accordance with the teaching of the above-identified Russian Inventor's Certificate.

It is known that for a constant current efficiency, the anodic current density is substantially proportional to the rate of manganese dioxide deposited at the anodic electrode. Thus, contrary to the prior art electrolytic processes for producing manganese dioxide, the process of this invention can be conducted at 10 times or more the current density of such prior art processes thereby increasing the deposition rate of manganese dioxide by a factor or 10 or more. This unexpected high rate of production of manganese dioxide in accordance with this invention can result in either the reduction of allocated plant sapce for producing manganese dioxide, or, using the same plant space, the manganese dioxide output can be increased by a factor of 10 or more.

The synergistic effect obtained in the production of battery grade manganese dioxide from the electrolysis of molten manganese nitrate hexahydrate within the high temperature range and high anodic current density range specified above will become apparent from the following examples.

EXAMPLE 1

Using the teachings of the prior art (Russian Inventor's Certificate No. 379,534), manganese dioxide was produced by electrolyzing manganese nitrate hexahydrate at a temperature of 100° C. and with an anodic current density of 10.6 mA/cm² in an electrolytic cell having a platinum cathode and a carbon anode. The manganese dioxide so produced was then blended to produce a cathode mix having the following proportions: 0.200 gram of $MnO_2$; 2 gram of coke; 1 gram of graphite; and 0.7 ml 9M KOH electrolyte. A conventional first test cell was prepared by placing inside a plastic container the cathode mix having an embedded spiral gold wire for electrical contact, a separator paper on top of the mix, a perforated plastic disc on top of the separator, a 9M KOH electrolyte solution disposed over the disc to fill the container and then a threaded plug containing a fritted glass tube having a platinum wire counter electrode and an Hg/HgO (9M KOH) reference electrode was screwed onto the top on the plastic container thereby securing all the components within the cell.

Figure 1:
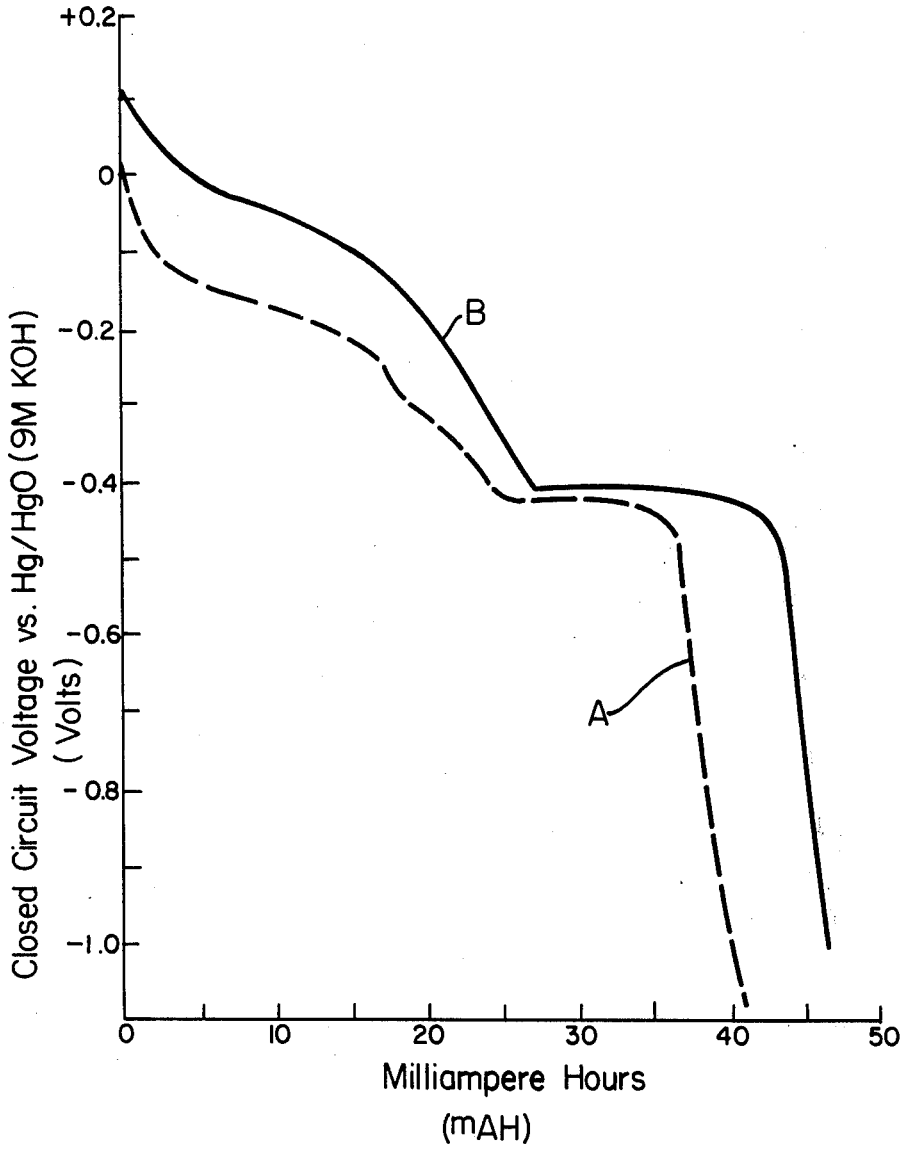
FIG. 1 is a graph of the closed circuit voltage vs. milliampere hours for cells using electrolytic manganese dioxide of the prior art.

The test cell was discharged on a 1 mA continuous drain and the closed circuit voltage vs. the reference electrode [Hg/HgO (9M KOH)] was observed and the data obtained are shown plotted in FIG. 1 as curve A. A second identical test cell was produced except that instead of the manganese dioxide used in the first test cell, the best commercially available grade of electrolytic manganese dioxide produced by the electrolysis of an aqueous manganese sulfate solution was used, said manganese dioxide being known commercially as Tekkosha EMD. The second test cell was then discharged on a 1 mA continuous drain and the closed circuit voltage vs. the reference electrode was observed and the data obtained are shown plotted in FIG. 1 as curve B. As is apparent from the curves, the Tekkosha EMD was far superior as an active cathode material than the manganese dioxide produced by the prior art process of electrolyzing molten manganese nitrate hexahydrate made in accordance with the teachings of Russian Inventor's Certificate No. 379,534.

EXAMPLE 2

Using an electrolytic cell having a graphite anode and a platinum cathode, manganese dioxide was produced by electrolyzing molten manganese nitrate hexahydrate at various temperatures and with various anodic current densities as shown in Table I.

TABLE I

| Sample No. | Deposition Conditions: Temperature ° C. | Current Density (mA.cm²) |
|---|---|---|
| 1 | 105 | 275 |
| 2 | 105 | 195 |
| 3 | 117 | 255 |
| 4 | 126 | 318 |
| *5 | 117 | 300 |

*The anodic electrode disintegrated during electrolysis.

Using the manganese dioxide samples 1 to 4 and the best commercially available grade of manganese dioxide produced by electrolyzing an aqueous manganous sulfate solution (Tekkosha), five test cells were produced as described in Example 1 such that each cell employed a different sample of manganese dioxide.

Each of the test cells was then discharged on a 1 mA continuous drain and the closed circuit voltage vs. the reference electrode of the test cell was observed. The data obtained for the tests are shown plotted in FIG. 2 as curves 1 through 5 which correspond to cells 1 to 5 employing the manganese dioxide samples 1 through 4 and the Tekkosha manganese dioxide sample, respectively.

Figure 2:
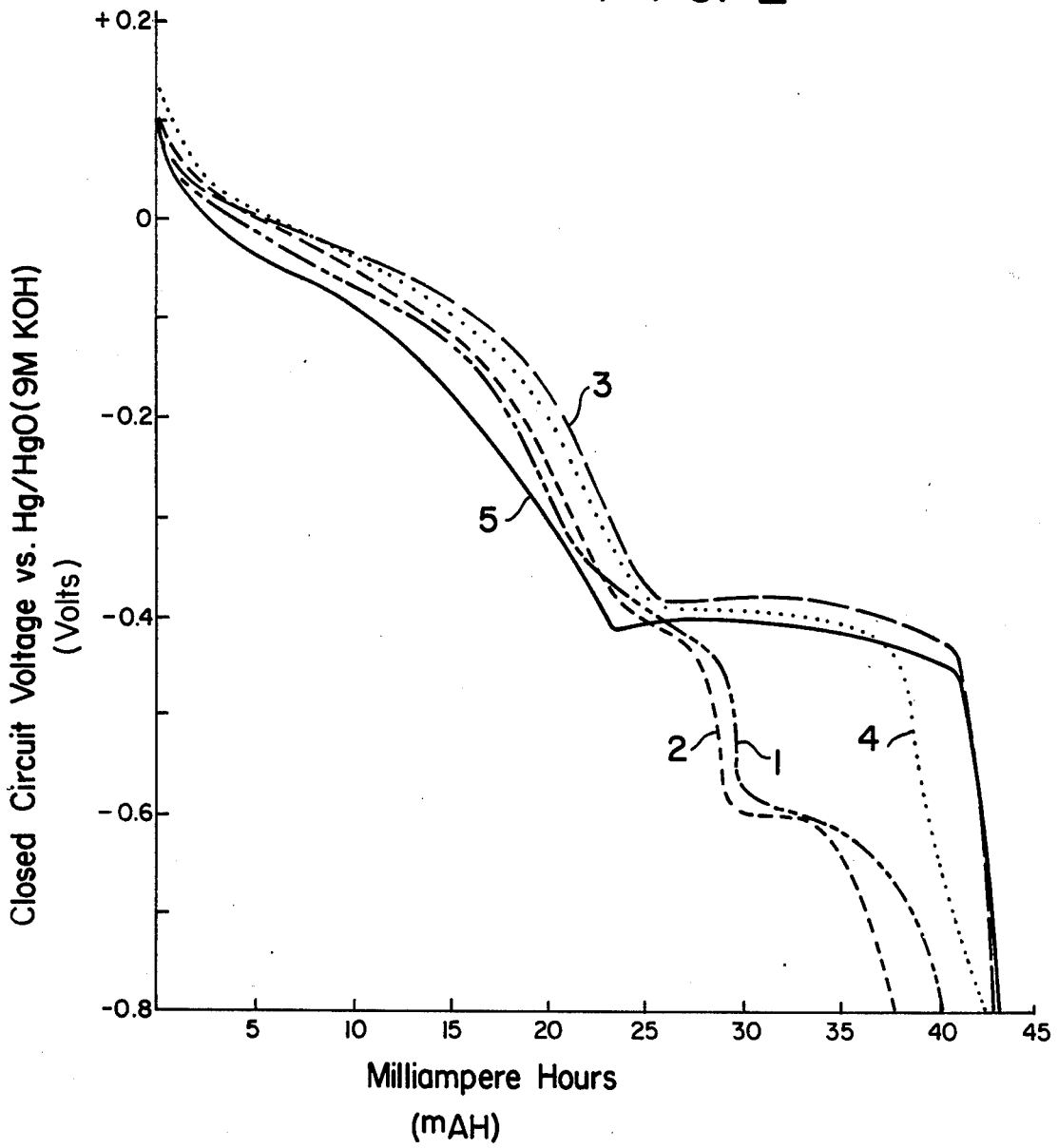
FIG. 2 is a graph of the closed circuit voltage vs. milliampere hours for cells employing electrolytic manganese dioxide of the prior art compared to cells employing electrolytic manganese dioxide made by the process of the present invention.

As is apparent from FIG. 2, the initial discharge step was very similar for all cells 1 through 5 with cell 5 (Tekkosha) exhibiting the lowest voltage of all. Cells 1 and 2, employing the lower temperature $MnO_2$ materials, discharged in the first step at a voltage of 20 to 50 mV higher than cell 5. Cells 3 and 4, employing the higher temperature $MnO_2$ materials, ran about 50 to 100 mV higher than cell 5. It is in the plateau of the second step where cells 1 and 2 showed both low voltage and low capacity. Contrary to this, cells 3 and 4 were still slightly higher in voltage on this plateau than cell 5, with cell 3, prepared at 117° C. and 225 MA/cm², being at least as good in capacity as cell 5 and cell 4 being only slightly lower in capacity than cell 5.

On the basis of the chemical testing and the discharge behavior of the samples of the manganese dioxide produced, the best material was produced unexpectedly at the high temperatures, preferably about 117° C. ± 2° C. which is about 10° C. below the level at which some thermal decomposition of the electrolyte can be observed. Since moderate variation within the current density range specified above is not as critical as the temperature variation, then one may choose a value just below the limiting current density for the optimum temperature to maximize plating rate and current efficiency while minimizing attack on the anode.

EXAMPLE 3

A total of about 100 g $MnO_2$ was prepared in five batches by electrolyzing molten $Mn(NO_3)_2.6H_2O$ over the following range of conditions:

Anode — graphite, 23–25 cm² surface area
Cathode — platinum screen
Temperature — 117° C
Average anode current density — 140–175 mA/cm²
Initial anode current density — 175–200 mA/cm²
Current efficiency — 55–83%.

Those runs with current efficiencies less than 80% contained salts with water in excess of water of crystallization ($.6H_2O$) as evidenced by water being observed coming off during the run. Properly dried salts all had efficiencies greater than 80%.

The five batches were combined, ground in a glass mortar with a pestle and then air-dried after being washed in an acid bath. The manganese dioxide was thereafter used as an active cathode material in nine "AA" size $ZnCl_2$ test cells. Each cell comprised a zinc can having therein a coated paper separator liner into which was placed a cathode mix with a centrally disposed carbon collector rod, a 32% $ZnCl_2$ electrolyte and then the can was closed using a conventional rim-vent seal. The cathode mix in each cell weighed 8.3 grams and consisted of 9.18% carbon black; 50.53% $MnO_2$; 12.29 $ZnCl_2$ and 28% water.

Nine additional cells (control cells) were produced identical to the cells described above except that Tekkosha electrolytic manganese dioxide was employed instead of the manganese dioxide prepared by electrolyzing molten manganese nitrate hexahydrate.

The 18 cells (nine test cells and nine control cells) were aged for three weeks and tested for open circuit voltage (OCV) and flash current (short circuit current). The data obtained from these tests are shown in Table II.

TABLE II

| Samples | Test Cells $MnO_2$ of Subject Invention | | Control Cells Tekkosha $MnO_2$ | |
|---|---|---|---|---|
| | Open Circuit Voltage (volts) | Flash Current (amperes) | Open Circuit Voltage (volts) | Flash Current (amperes) |
| 1 | 1.78 | 4.7 | 1.78 | 4.0 |
| 2 | 1.78 | 4.5 | 1.78 | 3.9 |
| 3 | 1.78 | 4.4 | 1.78 | 4.3 |
| 4 | 1.78 | 3.9 | 1.78 | 4.3 |
| 5 | 1.78 | 3.2 | 1.78 | 4.3 |
| 6 | 1.78 | 4.3 | 1.78 | 4.4 |
| 7 | 1.78 | 3.9 | 1.78 | 4.4 |
| 8 | 1.78 | 3.8 | 1.78 | 4.2 |
| 9 | 1.78 | 3.8 | 1.78 | 4.1 |
| Average | 1.78 | 4.1 | 1.78 | 4.2 |

As is apparent from the above, the average open circuit voltage and average flash current of the cells using the $MnO_2$ produced in accordance in this invention are substantially equivalent to the average open circuit voltage and average flash current of the cells which employed the best commercially available manganese dioxide produced by electrolyzing an aqueous manganous sulfate solution.

Figure 3:
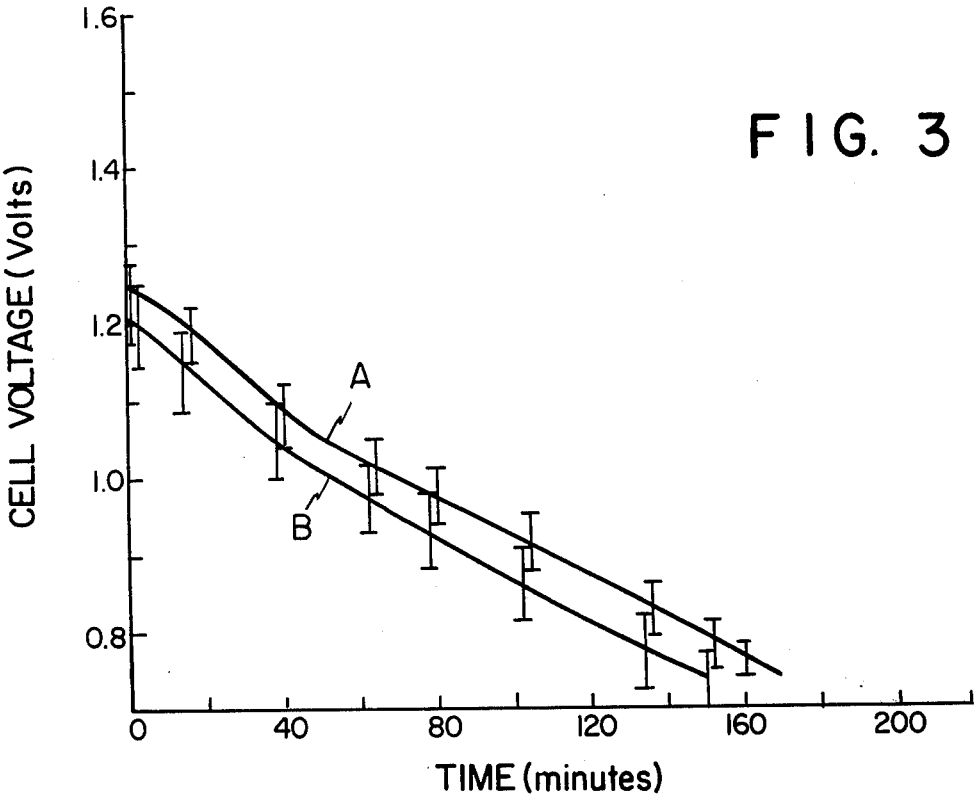
FIG. 3 shows a graph of the average cell voltage vs. time for cells employing the electrolytic manganese dioxide of the prior art compared to cells employing electrolytic manganese dioxide made in accordance with the process of this invention when discharged across a 4-ohm load.

Three of the test cells and three of the control cells were then continuously discharged across a 4-ohm load. The data obtained from this test are shown plotted in FIG. 3 with curve A representing the test cells made using the $MnO_2$ as produced in accordance with this invention and curve B representing the control cells which used the Tekkosha $MnO_2$. The data for each set of three cells were plotted for specific time periods and then a line (vertical line) was drawn connecting the three points. The midpoints of the vertical lines for each set of three cells, i.e., the three test cells and the three control cells, were then used in preparing curves A and B, respectively. As is apparent from FIG. 3, the performance of the test cells using the $MnO_2$ prepared in accordance with the process of this invention was superior to that of the control cells which employed Tekkosha $MnO_2$.

Figure 4:
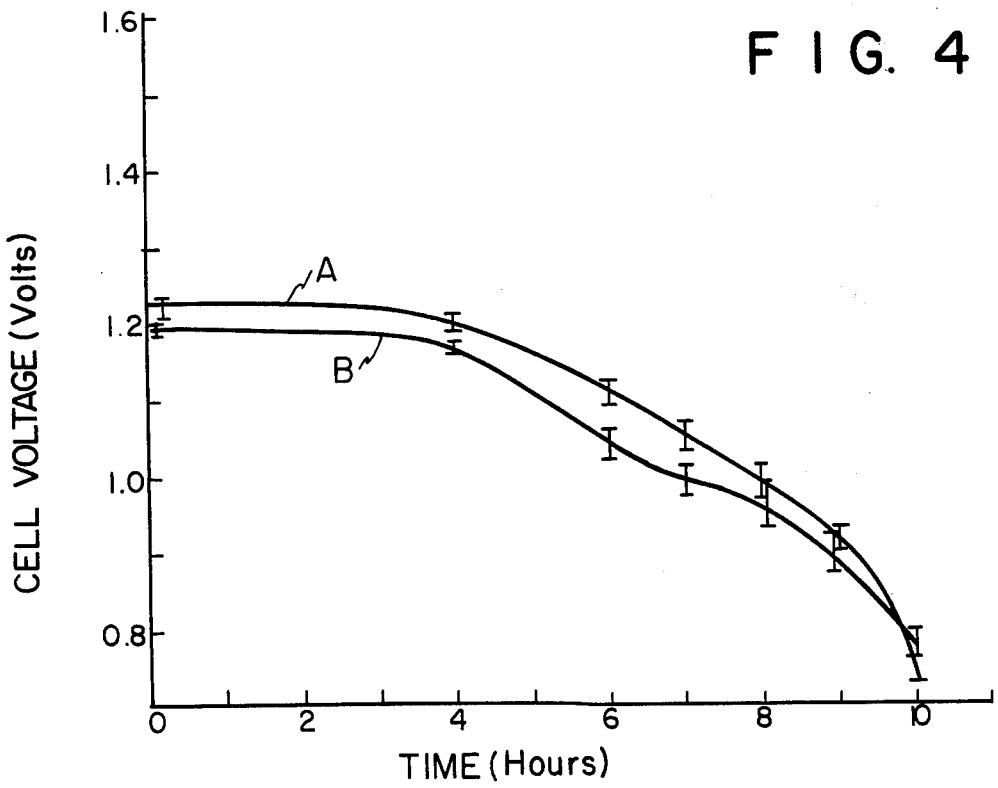
FIG. 4 shows a graph of the average cell voltage vs. time for cells employing the electrolytic manganese dioxide of the prior art compared to cells employing electrolytic manganese dioxide made in accordance with the process of this invention when discharge across a 12-ohm load.

Another three of the test cells and another three of the control cells were continuously discharged across a 12-ohm load which represents the typical load of a small calculator. Using the same technique as described in conjunction with FIG. 3, that data obtained from this test are shown plotted in FIG. 4 with curve A representing the test cells made using the $MnO_2$ as produced in accordance with this invention and curve B representing the control cells which used the Tekkosha $MnO_2$. As is apparent from FIG. 4, the performance of the test cells using the $MnO_2$ prepared in accordance with the process of this invention was superior to that of the control cells which employed Tekkosha $MnO_2$.

Figure 5:
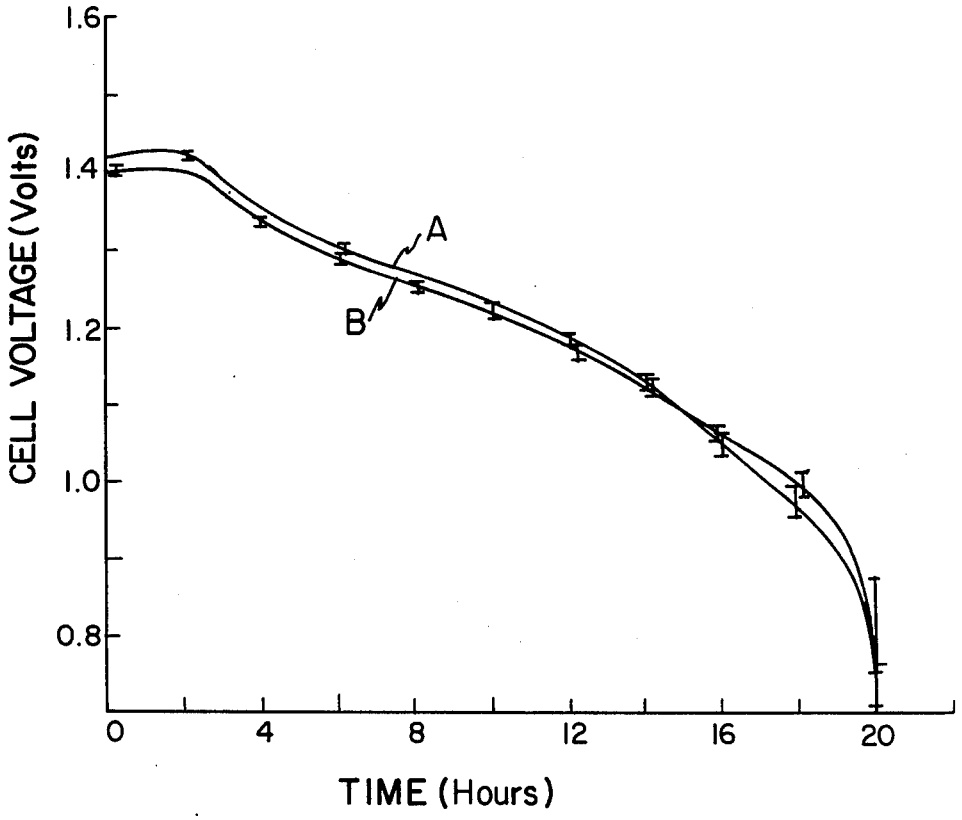
FIG. 5 shows a graph of the average cell voltage vs. time for cells employing the electrolytic manganese dioxide of the prior art compared to cells employing electrolytic manganese dioxide made in accordance with the process of this invention when discharge across a 25-ohm load.

The remaining three test cells and remaining three control cells were continuously discharged across a 25-ohm load which represents the typical lead of a portable size radio. Using the same technique as described in conjunction with FIG. 3, the data obtained from this test are shown plotted in FIG. 5 with curve A representing the test cells and curve B representing the control cells. As is apparent from FIG. 5, the performance of the test cells using the $MnO_2$ prepared in accordance with the process of this invention was superior to that of the control cells which employed Tekkosha $MnO_2$.

EXAMPLE 4

Twenty alkaline test cells were produced, each using a zinc anode, a carbon collector rod, a 9N KOH electrolyte and 3.2 grams of depolarizer mix containing 80% $MnO_2$ (as prepared and described in Example 3), 7.5% graphite, 1.5% acetylene black and 11% 9N KOH. In addition, 20 identical control cells were produced except that the $MnO_2$ used was Tekkosha $MnO_2$ prepared by electrolyzing an aqueous manganous sulfate solution. Five of each type of cells were then intermittently discharged across a different load until a 0.9 cutoff voltage was observed. The average discharge time for each set of five cells to a 0.9 volt cutoff and the discharge load used are shown in Table III. The control cells used in the 25-ohm, 150-ohm tests were fresh cells (not aged) and those used in the 125-ohm test were six months old. All the test cells used in the various tests were four months old.

TABLE III

| Load Test | Intermittent Discharge Time | Test Cells Average Discharge Time (hours) | Control Cells Average Discharge Time (hours) |
|---|---|---|---|
| 25-Ohm | 4 hrs/day | 11.0 | 12.4 |
| 125-Ohm | 4 hrs/day | 65.0 | 70.0 |
| 150-Ohm | 16 hrs/day | 84.0 | 87.6 |
| 250-Ohm | 16 hrs/day | 149.6 | 143.0 |

It can be concluded from the above data that the performance of alkaline cells employing the $MnO_2$ made in accordance with this process is comparable to that of the alkaline cells employing the best commercially available $MnO_2$ prepared by electrolyzing an aqueous manganous sulfate solution.

What is claimed is:

1. In a process for producing battery grade electrolytic manganese doixide by electrolyzing molten manganese nitrate hexahydrate, the improvement being the electrolyzing of the manganese nitrate hexahydrate at a temperature between about 115° C. and 126° C. and with an anodic current density of from about 140 to about 300 mA/cm².

2. The process of claim 1 wherein the temperature is between about 115° C. and 119° C.

3. The process of claim 1 wherein the temperature is about 117° C.

4. The process of claim 1 wherein the anodic current density is from about 150 to about 200 mA/cm².

5. The process of claim 2 wherein the anodic current density is from about 150 to about 200 mA/cm².

6. The process of claim 3 wherein the anodic current density is from about 150 to about 200 mA/cm².

* * * * *